United States Patent [19]

Suzuki et al.

[11] 4,390,265

[45] Jun. 28, 1983

[54] IMAGE FORMING APPARATUS

[75] Inventors: Koji Suzuki, Yokohama; Tsuneki Inuzuka, Machida; Kenji Kurita, Mitaka, all of Japan

[73] Assignee: Canon Kabushiki Kaisha, Tokyo, Japan

[21] Appl. No.: 194,985

[22] Filed: Oct. 8, 1980

Related U.S. Application Data

[63] Continuation of Ser. No. 969,885, Dec. 15, 1978, abandoned.

[30] Foreign Application Priority Data

Dec. 21, 1977 [JP] Japan ..... 53-7839

[51] Int. Cl.[3] ..... G03G 15/06; G03G 15/10

[52] U.S. Cl. ..... 355/14 D; 355/3 R; 355/14 E

[58] Field of Search ..... 355/3 R, 3 CH, 10, 14 R, 355/14 CH, 14 E, 14 D; 324/452, 455, 457, 458

[56] References Cited

U.S. PATENT DOCUMENTS

| | | | |
|---|---|---|---|
| 3,788,739 | 1/1974 | Coriale | 355/3 R X |
| 3,819,261 | 6/1974 | Ogawa | 355/14 R |
| 3,960,446 | 6/1976 | Ogawa et al. | 355/3 R X |
| 3,990,791 | 11/1976 | Tsukada | 355/3 R |
| 3,998,538 | 12/1976 | Urso et al. | 355/3 R |
| 4,000,944 | 1/1977 | Fraser | 355/14 R |
| 4,017,170 | 4/1977 | Komori et al. | 355/3 R |
| 4,110,031 | 8/1978 | Ebi et al. | 355/3 CH X |
| 4,136,942 | 1/1979 | Nakahata et al. | 355/3 CH |
| 4,136,945 | 1/1979 | Stephens | 355/14 E |

*Primary Examiner*—Fred L. Braun

*Attorney, Agent, or Firm*—Fitzpatrick, Cella, Harper & Scinto

[57] ABSTRACT

An imaging forming apparatus in which a photosensitive member is electrostatically charged and the charged area is exposed to light to form a latent image which is subsequently developed to obtain an image the apparatus being featured in that the imaging area on the photosensitive member is exposed to the light of an arbitrary amount while the non-imaging area on the photosensitive member is exposed to the light of an amount determined irrespective of the arbitrary amount, and the surface potential of the area exposed to the light of the determined amount is measured thereby controlling the image formation according to the measured output.

12 Claims, 12 Drawing Figures

IMAGE FORMING APPARATUS

This is a continuation of application Ser. No. 969,885, filed Dec. 15, 1978, now abandoned.

BACKGROUND OF THE INVENTION

1. Field of the Invention

The present invention relates to an image forming apparatus utilizing an electrophotographic process. More specifically the present invention relates to an image forming apparatus utilizing an electrophotographic process wherein a photosensitive member in the form of a flat plate, a drum or an endless belt is subjected to charge deposition by a corona discharge and is then exposed to a light image of an original to selectively eliminate said charge thereby forming a latent image which is subsequently rendered visible by depositing toner particles having a charge of a polarity opposite to that of said latent image, said apparatus being capable of preventing image deterioration resulting from the time-dependent or environment-dependent changes in the charging characteristics of the photosensitive member.

2. Brief Description of the Prior Art

As the charging characteristics of the photosensitive member are subject to significant changes of a time-dependent nature and also resulting from variations in the environmental conditions such as circumferential temperature and humidity, the user of the image forming apparatus, for example a copier, has been required to control the image density by manipulating a copy density dial for controlling a diaphragm provided in the optical system.

As the number of copies increases, the charging characteristics of the photosensitive member gradually vary from the initial values and eventually exceeds the density adjustable range of the diaphragm control dial, thus necessitating the replacement of the photosensitive member with a new one. For this reason the photosensitive member has been of a limited service life and has required frequent replacements.

There have therefore been proposed various methods for stabilizing the image density by measuring the latent image potential on the photosensitive member and controlling the developing bias according to the measured potential. Among these methods, particularly simple is a method for stabilizing the image density by measuring and holding the latent image potential of a highlight area obtained by exposure of a white area of an original or of an original support table, and by controlling the developing bias by means of a developing bias amplifier in such a manner as to maintain a constant difference or a constant linear relationship between the potential thus held and the developing bias. However, in a copier of which the optical system is provided with a diaphragm for controlling the image density according to the background color of the original, a change in the aforementioned highlight potential caused by changing the amount of exposure by said diaphragm is unable to achieve its intended object as the developing bias is regulated by said developing bias amplifier so as to compensate for such change.

SUMMARY OF THE INVENTION

The object of the present invention is therefore to provide an image forming apparatus capable of controlling the image forming means independently from the change of the amount of exposure by exposure control means. More specifically the object of the present invention is to provide an image forming apparatus wherein an imaging area of the photosensitive member is exposed to light of an arbitrary amount while a non-imaging area of the photosensitive member is exposed to light of an amount determined independently from said arbitrary amount, and the surface potential of the area subjected to the light exposure of said determined amount to control the image formation by means of the measured output.

Another object of the present invention is to provide an image forming apparatus capable of controlling the image forming means and thus providing a stable image quality by detecting the surface potential of a non-imaging area irradiated by non-imaging exposure means thereby controlling the image forming means so as to prevent deposition of toner particles onto the non-imaging area.

Still another object of the present invention is to provide a process for stabilizing image formation by measuring the surface potential formed during the period of cleaning of the photosensitive member thereby controlling the image forming process.

DESCRIPTION OF THE PREFERRED EMBODIMENTS

Figure 1:
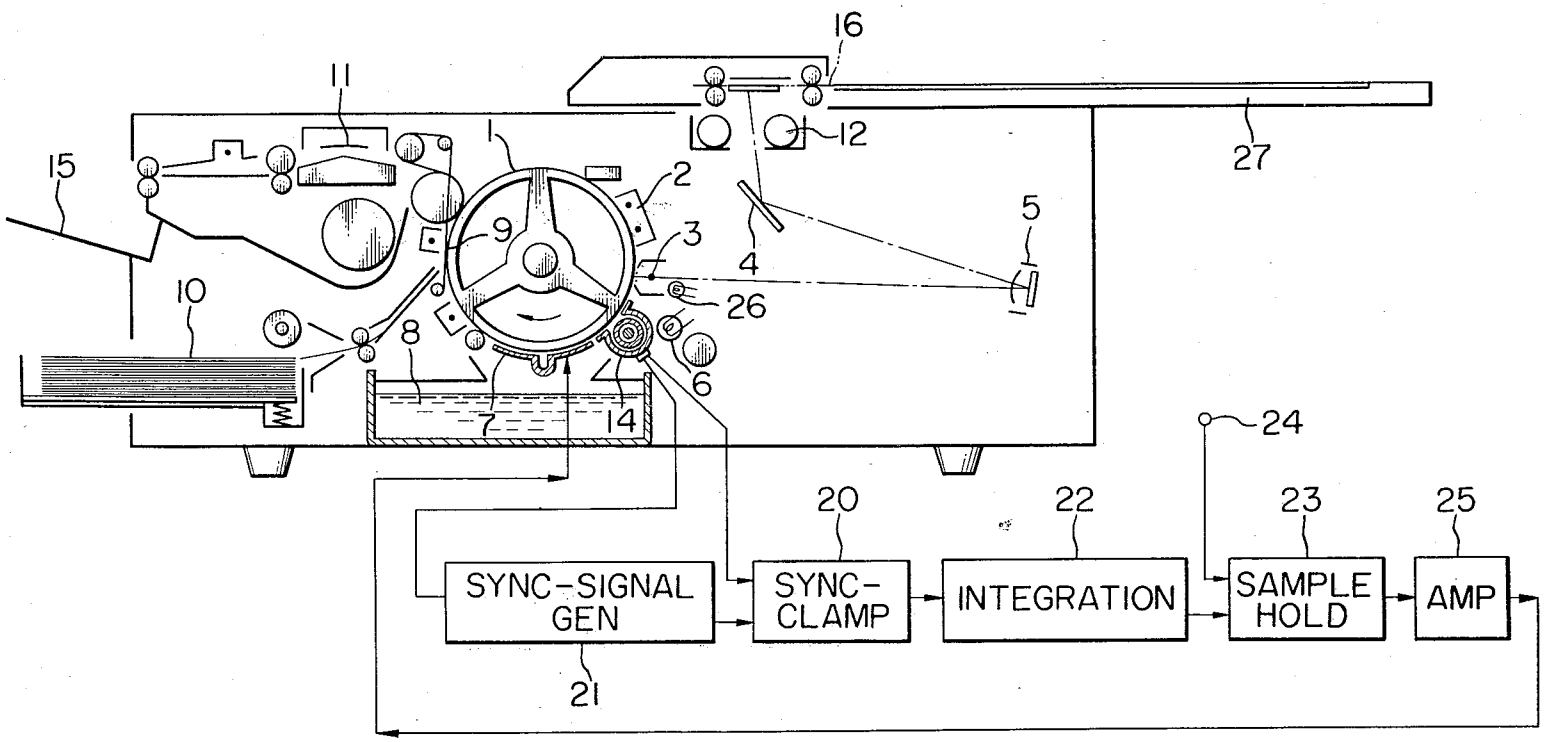
FIG. 1 is a schematic diagram of an electrophotographic copying apparatus embodying the present invention.

The present invention will be clarified by the following description on an embodiment thereof applied to an electrophotographic copying apparatus as shown in FIG. 1, wherein a photosensitive drum 1, composed of a conductive drum provided on the periphery thereof with a very thin photosensitive layer and a very thin insulating layer and rotated in the direction of arrow, is subjected to a uniform charging on the periphery thereof by a corona discharge from a primary charger 2, successively subjected to a corona discharge of the opposite polarity or of alternating current by a secondary charger 3 simultaneously with an exposure to a light image transmitted through an optical system 4, 5 from an original 16 illuminated by a lamp 12, thereby eliminating the charge in the exposed area, and further illuminated uniformly by a flash exposure lamp 6 to reduce the resistance of the photosensitive layer thereby forming a contrast in the potential, namely a latent image, on the drum surface. Said latent image is sprayed with a liquid developer 8 in a developing tray 7 to deposit the toner particles having a charge of a polarity opposite to that of the charge of said latent image thereby completing the development. The developed image is transferred in a transfer station 9 onto a transfer sheet 10, which is then heat fixed in a fixing device 11 and ejected to a tray 15.

Figure 2:
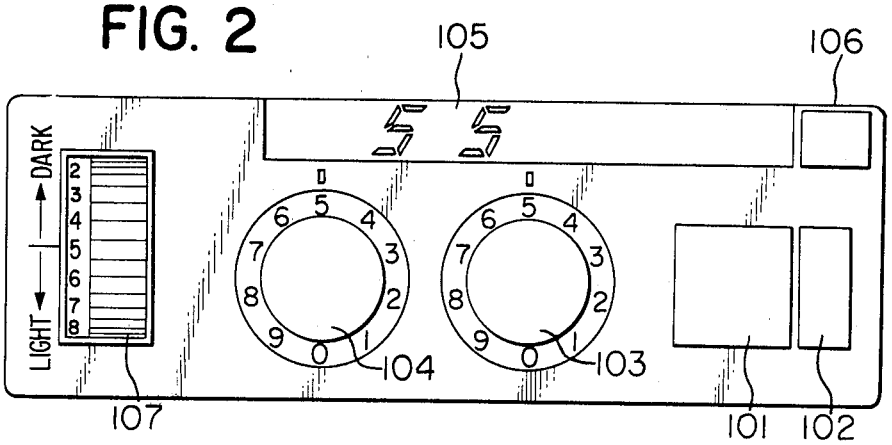
FIG. 2 is a plan view of the control panel of the copying apparatus shown in FIG. 1.

FIG. 2 shows a control panel of the copying apparatus shown in FIG. 1, wherein there are shown a button 101 for plural continuous copying instruction, a single copy instruction button 102, dials 103, 104 respectively for setting the first and second digit of the copy number, 7-segment display array 105 for displaying the preset copy number before the start of the copy cycle or displaying the completed copy number after the start of copy cycle, a copy interruption instruction button 106, and a density adjust dial 107.

A rotation of the density adjust dial 107 causes the rotation of a ring of a diaphragm provided in the optical system 5 to vary the aperture of said diaphragm thereby changing the amount of light supplied to the photosensitive drum 1. The mechanism for changing the diaphragm aperture is already known in the art and will not, therefore, be explained in detail.

Figure 3:
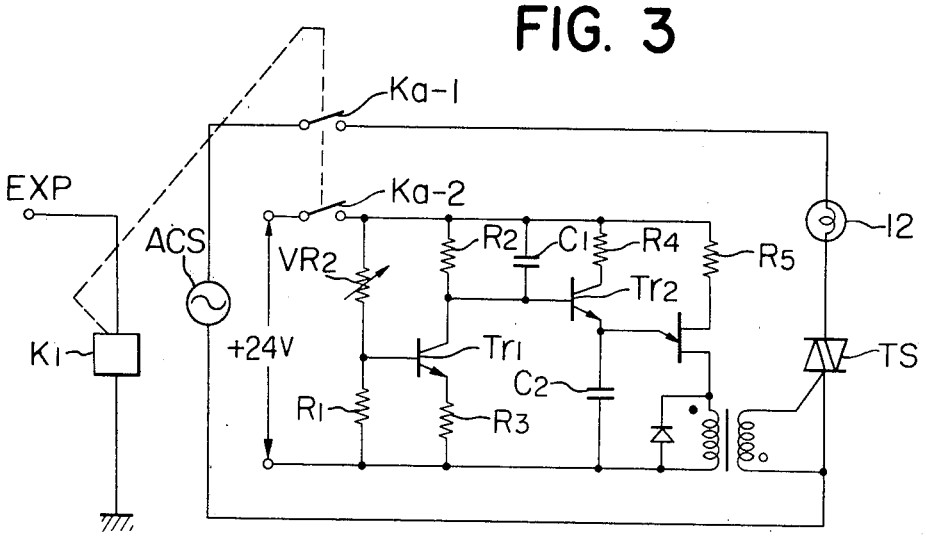
FIG. 3 is a circuit diagram for controlling the amount of light.

The adjustment of the amount of light supplied to the photosensitive member is also achievable by regulating the amount of light emitted by the exposure lamp 12, by means of a light control circuit shown in FIG. 3, in which, upon receipt of an exposure signal EXP, a relay K1 is activated to close normally open contacts Ka-1, Ka-2 thereby lighting the exposure lamp 12. The density adjust dial 107 provided on the control panel varies the resistance of a variable resistor VR2 to achieve phase control of a triac TS thereby regulating the amount of power supplied to the exposure lamp 12, namely the amount of light emitted therefrom.

Figure 4:
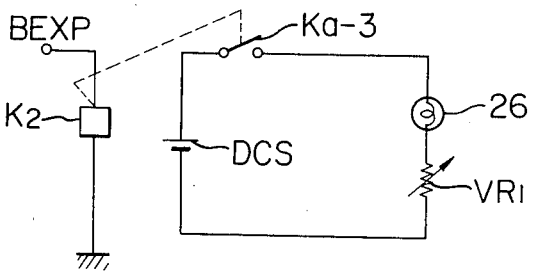
FIG. 4 is a circuit diagram for setting the amount of light from a blank lamp.

In order to prevent deposition of toner particles outside the imaging area of the photosensitive drum 1 there is provided a blank exposure lamp 26 of which the amount of light is previously adjusted to a level of amount of light to be given to the photosensitive drum 1 by the exposure lamp 12 when the density adjust dial 107 is placed at the center of the adjustable range thereof. Said adjustment is achieved by irradiating the photosensitive drum 1 with the exposure lamp 12 while placing the density adjust dial 107 at the center of the adjustable range thereof thereby forming a latent image on said drum, measuring the potential of the thus formed latent image with a surface potential meter 14 and adjusting a variable resistor VR1 shown in FIG. 4 in such a manner that the potential thus measured becomes equal to the measured potential of a latent image formed by irradiating the photosensitive drum 1 with the blank exposure lamp 26. Upon receipt of an instruction for starting the copy cycle, and during a rotation of the photosensitive drum for removing the remaining charge and toner prior to the copy cycle, the photosensitive drum 1 is charged by the corona discharge from the primary charger 2 and is exposed to the light of a determined amount from the blank exposure lamp 26 to form a uniform potential on the photosensitive drum. In this manner the photosensitive drum is cleaned and enables stable image formation in the succeeding copy cycle. The charge on the photosensitive drum thus exposed to the light of said determined amount, namely the charge formed in said cleaning, is of an amount approximately equal to that of the charge obtained by the exposure of a white area of the original when the density adjust dial is placed at the center of the adjustable range thereof.

As the original support table 27 is stopped during the above-mentioned rotation of the photosensitive drum 1, the light emitted by the exposure lamp 12 is reflected by a portion other than the proper surface of said table to irradiate the photosensitive drum. It is therefore necessary to blacken the surface of said table 27 other than the original supporting area thereof in order to prevent the light of the exposure lamp 12 from reaching the photosensitive drum 1 through the diaphragm during the abovementioned measurement of the potential of latent image, or to extinguish said exposure lamp during said rotation for cleaning.

The surface potential meter 14 is provided between the flash exposure lamp 6 and the developing station 7 to measure the latent image potential before the development step, and the output of said potential meter is converted into a DC signal in a synchronizing clamp circuit 20 by a synchronizing signal generated by a synchronizing signal generator 21, then integrated in an integrating circuit 22 and supplied to a sample hold circuit 23.

Said sample hold circuit 23 extracts and holds the amplitude component of the output from the integrating circuit 22 at a determined timing signal supplied to a terminal 24. The output thus held is supplied, after amplification by an amplifier 25, to the developing tray 7 thereby maintaining the potential difference between the photosensitive drum 1 and the developing tray 7 at a constant value suitable for conducting a development meeting the latent image potential.

Upon termination of the cleaning period, the blank exposure lamp 26 is extinguished and the original support table 27 starts the advancement to initiate the copy cycle. The foregoing sequence is represented in the timing chart shown in FIG. 5.

In the foregoing embodiment there has been explained a control of the developing bias in response to the measured potential of the latent image formed on the photosensitive drum, but the same effect can be obtained also by controlling the potential of the primary or secondary charging in response to the measured potential of the latent image.

Furthermore, though the foregoing embodiment has been explained in conjuction with an image forming apparatus comprising two chargers as the charging means for the photosensitive member, the present invention is naturally applicable also to an image forming apparatus utilizing an electrophotographic process requiring only one charging means, for example the Carlson process.

The process for stabilizing image formation according to the present invention, which is featured as explained in the foregoing by irradiating the photosensitive member with the light of a determined amount by an irradiating means to form a latent image, of which highlight potential is measured to control the image forming means such as the charger or charge eliminater as well as the developing bias, while the amount of light of the irradiating means irradiating the photosensitive member at the image formation being rendered independently variable, allows to prevent image deterioration resulting from the environment- or time-dependent changes in the charging characteristics of the photosensitive member without reducing the adjustable range of the density adjust means. Also said process facilitates the control of the amount of light of the exposure lamp irradiating the photosensitive member by the use of a separate light source, other than said exposure lamp, for the measurement of surface potential as explained in the foregoing embodiment.

Furthermore the above-mentioned process, wherein said determined amount of light is previously adjusted equal to the amount of light reflected by a white area of the original and supplied to the photosensitive member from the exposure lamp when the density adjust dial is placed at an approximately central position in the adjustable range thereof, allows a highly precise compensation meeting with the highlight potential characteristics of the photosensitive member at the image formation.

Furthermore the above-mentioned process allows a high-speed image formation as the measurement of the surface potential for controlling the image formation is conducted during the cleaning step for forming a uniform surface potential on the photosensitive member and does not therefore require an additional time.

Figure 6:
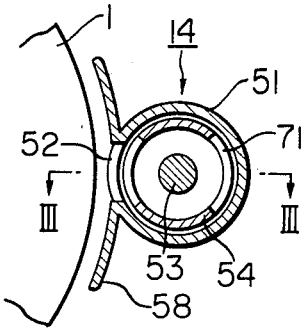
FIG. 6 is a lateral cross-sectional view of a surface potential meter.
Figure 7:
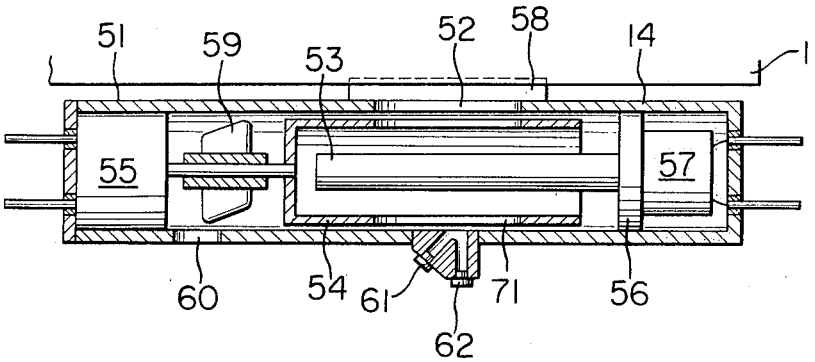
FIG. 7 is a frontal cross-sectional view along the line III—III in FIG. 6.

FIGS. 6 and 7 illustrate the details of the surface potential meter 14 in which a conductive shield cylinder 51 having an axially elongated aperture 52 is mounted parallel to the photosensitive drum 1 in such a manner that said aperture 52 faces said drum 1 thereby guiding the electric field of the latent image to a measuring electrode 53 provided inside said cylinder 51, which is supplied with a determined bias potential to minimize the effect of external electric field other than that of the latent image.

Between the shield cylinder 51 and the electrode 53 there is coaxially provided a conductive cage-shaped rotary chopper 54 having equally spaced plural apertures 71 of substantially the same shape as that of said aperture 52 of the shield cylinder 51, said chopper being rotated at a high speed by a motor 55 incorporated at an end of the cylinder 51 to interrupt the electric field resulting from the latent image on the photosensitive drum 1 at a determined frequency thereby supplying an alternating current signal to the measuring electrode 53. Said alternating current signal induced on the measuring electrode is required to be of a frequency at least equal to 100 Hz as a lower frequency does not allow precise measurement due to the effect of low-frequency noises. In the illustrated embodiment the motor is rotated in such a manner that said frequency is equal to 300 Hz.

Said cage-shaped chopper is biased for example at a potential the same as that of the shield cylinder 51 through the rotating shaft or by other suitable means such as a slip ring if said shaft is non-conductive.

The measuring electrode 53 is composed of a conductive rod fixed on the central axis of the shield cylinder 51 by means of an insulating plate 56 composed of a highly insulating material such as tetrafluoroethylene. Said measuring electrode 53 is directly connected to the input terminal of an amplifier 57 (to be explained later) incorporated in the other end of said cylinder 51, whereby the signal of an extremely high impedance induced in the measuring electrode 53 is converted to a signal of a low impedance which is then guided to the outside of the cylinder 51 to enable measurement with an elevated S/N ratio and without attenuation in the cable or influence of external noises.

In FIG. 6 there is further shown a conductive shield plate 58 which is provided outside the aperture 52 for further improving the S/N ratio by interrupting the external electric field for example a noise field resulting from an AC charger provided in the vicinity of the surface potential meter.

In order to prevent intrusion of toner particles and other dust, the potential meter is provided, between the motor 55 and the cage-shaped chopper 54, with a propeller 59 which inhales clean air from an inlet 60 provided on said cylinder 51 and ejects said air from said aperture 52. In this manner it is rendered possible to prevent the increase of rotational load resulting from dust deposition on the bearings, the deterioration of insulation resistance between the measuring electrode and the shield cylinder resulting from dust deposition on the insulating plate 56 and the fluctuation of the measured potential resulting from deposition of chargeable dust on the measuring electrode 53, and thus to achieve stable measurement of the latent image potential.

For detecting the interrupting cycles of the electric field by the cage-shaped chopper, the embodiment shown in FIG. 7 is provided with a photocoupler composed of a light-emitting diode 61 and a phototransistor 62 both mounted on the shield cylinder 51, wherein the light emitted by said light-emitting diode 61 is reflected by the conductive wall of the chopper 54 and received by said phototransistor 62 to generate an output signal indicating the interrupting cycles.

Figure 8:
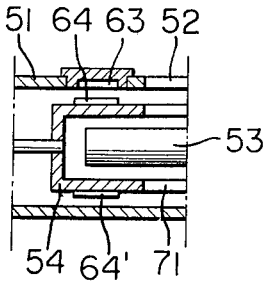
FIG. 8 is a partial frontal cross-sectional view of a surface potential meter showing an example of phase detecting means.

In FIG. 8 there is shown another detecting means for said interrupting cycles, said means utilizing magnetic coupling between a Hall-effect element 63 mounted on the shield cylinder 51 and a magnet 64 mounted on the cage-shaped chopper 54, wherein the detection output signal is obtained when the magnetic field of said magnet 64 activates the Hall-effect element 63. Another magnet 64' is provided axially symmetrical to said magnet 64 to rotationally balance the chopper 54, but said another magnet 64' is directed magnetically inserve to said magnet 64 so that said another magnet 64' does not activate the Hall-effect element 63.

Figure 9:
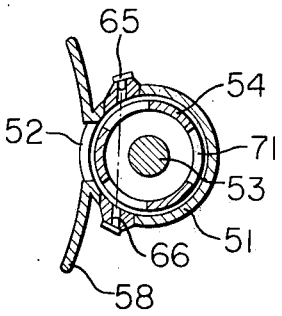
FIG. 9 is a lateral cross-sectional view of a surface potential meter constituting another embodiment of the phase detecting means.

In the embodiment shown in FIG. 9 a photoelectric detecting means is composed of a light-emitting diode 65 and a phototransistor 66 mounted in a mutually facing relationship on the shield cylinder 51, wherein the light emitted by said light-emitting diode 65 is received by said phototransistor 66 through the apertures 71 of the cage-shaped chopper 54 to generate the detection signal.

Figure 10:
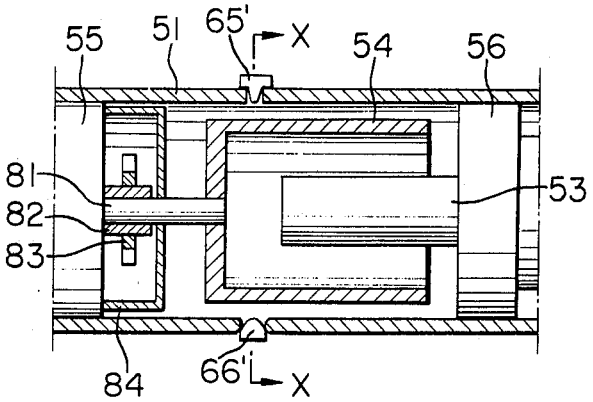
FIG. 10 is a lateral cross-sectional view of still another embodiment of the surface potential meter.
Figure 11:
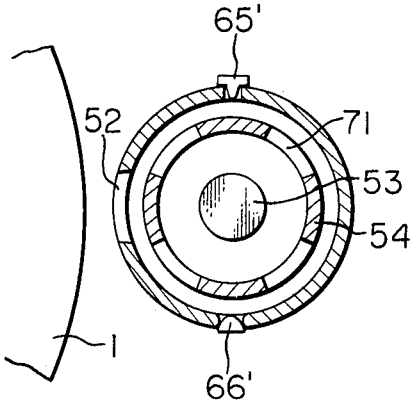
FIG. 11 is a cross-sectional view along the line X—X in FIG. 10.
Figure 12:
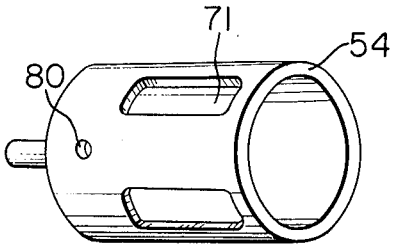
FIG. 12 is a persepective view of a cage-shaped chopper.

In contrast to the embodiment shown in FIG. 9 wherein said detection is achieved by the light passing through the apertures 71 of the chopper 54, the embodiment shown in FIGS. 10, 11 and 12 utilizes detection by openings 80 provided on the chopper exclusively for passing the light from the light-emitting diode.

In the illustrated embodiment the chopper 54 is provided with equally spaced four apertures 71 for the potential measurement and also with equally spaced four openings 80 for passing the light of the light-emitting diode, each positioned exactly between said apertures 71. Due to the periodical interruption of the electric field between the drum surface and the measuring electrode 53, an alternating current signal is induced therein and transmitted to a synchronizing clamp circuit 20 which is to be explained later. Also each time said chopper 54 interrupts the electric field between the surface of the drum 1 and the electrode 53, the light from the light-emitting diode 65′ is received by the phototransistor 66′ to generate a synchronizing signal.

The signal induced in the measuring electrode 53 is of an extremely high impedance and is therefore easily affected by the external noises. For this reason an eventual fluctuation in the potential of said chopper 54 affects said signal. In the present embodiment, however, the potential of the chopper can be stably controlled as the rotating shaft 81 is grounded through a casing 84, a motor cover and the shield cylinder 51 by means of a slip ring 82 mounted on said shaft 81 and grounding brushes 83. Besides said brushes 83 are contained in a totally enclosed casing 84 to prevent electrical noise generation eventually resulting from deposition of dusts such as toner particles onto said brushes.

The cage-shaped chopper employed in the present embodiment allows size reduction of the potential meter in comparison with the conventional impeller type chopper. The diameter of the shield cylinder, chopper and electrode of the present embodiment can be, for example, 12, 8 and 6 mm, respectively. It is to be noted however that the present invention is applicable not only to the potential meter of the above-mentioned type but also to the potential meter of any other type.

The aforementioned synchronizing clamp circuit 20, synchronizing signal generator 21, integrating circuit 22, sample hold circuit 23 and amplifier 25 are already described in the U.S. patent application, Ser. No. 956,330 filed Oct. 31, 1978.

What we claim is:

1. An image forming apparatus comprising:

a photosensitive member on which an electrostatic image may be repeatedly formed;

image forming process means including charging means for electrostatically charging the surface of said photosensitive member, exposure means for exposing said photosensitive member to a light image for forming an electrostatic latent image corresponding to said light image, and developing means for developing said latent image with a developer;

means for setting a light quantity level of said exposure means which is variable inclusively within a range extending between a lower limit and an upper limit;

means for detecting a state of the surface of said photosensitive member during a non-imaging period before start of the latent image formation, wherein said photosensitive member is exposed to the light of a predetermined quantity corresponding to a quantity which is not less than the lower limit but less than the upper limit during the non-imaging period, and is exposed to the light of the quantity set by said setting means during imaging; and control means for controlling at least one of said image forming process means in accordance with an output of said detecting means.

2. An apparatus according to claim 1, wherein said control means controls a bias voltage applied to said developing means.

3. An apparatus according to claim 2, wherein said control means controls the bias voltage so as to maintain a constant potential difference between said developing means and said photosensitive member.

4. An apparatus according to claim 1, wherein said non-imaging period occurs while said photosensitive member is being cleaned.

5. An apparatus according to claim 1, wherein said image forming process means further includes blank exposure means for effecting said non-imaging exposure to prevent possible toner deposition on the photosensitive member at non-image areas.

6. An apparatus according to claim 5, wherein said blank exposure means is energized at all times during operation of said charging means except for the period during which said imaging exposure means is turned on.

7. An apparatus according to claim 1, wherein said state of said photosensitive member is a surface potential thereof.

8. An image forming apparatus comprising:

a photosensitive member on which an electrostatic image may be repeatedly formed;

image forming process means including charging means for electrostatically charging the surface of said photosensitive member, exposure means for exposing said photosensitive member to a light image for forming an electrostatic latent image corresponding to said light image, and developing means for developing said latent image with a developer;

means for setting a light quantity level of said exposure means which is variable within a predetermined range;

means for detecting, during a non-imaging period, a state of the surface of said photosensitive member to which a predetermined quantity of light is applied, said predetermined quantity being determined corresponding to a quantity of light which is not less than the lower limit of said range but less than the upper limit thereof; and control means responsive to said detecting means for controlling at least one of said image forming process means in accordance with said detected state.

9. An apparatus according to claim 8, wherein said control means controls a bias voltage applied to said developing means.

10. An apparatus according to claim 9, wherein said control means controls the bias voltage so as to maintain a constant potential difference between said developing means and said photosensitive member.

11. An apparatus according to claim 8, wherein said non-imaging period occurs while said photosensitive member is being cleaned.

12. An apparatus according to claim 8, wherein said image forming process means further includes blank exposure means for effecting said non-imaging exposure to prevent possible toner deposition on the photosensitive member at non-image areas.

* * * * *

UNITED STATES PATENT AND TRADEMARK OFFICE

CERTIFICATE OF CORRECTION

PATENT NO. : 4,390,265

DATED : June 28, 1983

INVENTOR(S) : KOJI SUZUKI, ET AL.

It is certified that error appears in the above-identified patent and that said Letters Patent is hereby corrected as shown below:

At the top of Sheets 1 and 2 of drawings, change "of 6" to read --of 5--.

Delete the sheet of drawings which bears the legend "Sheet 3 of 6" at the top thereof.

Figure 5:
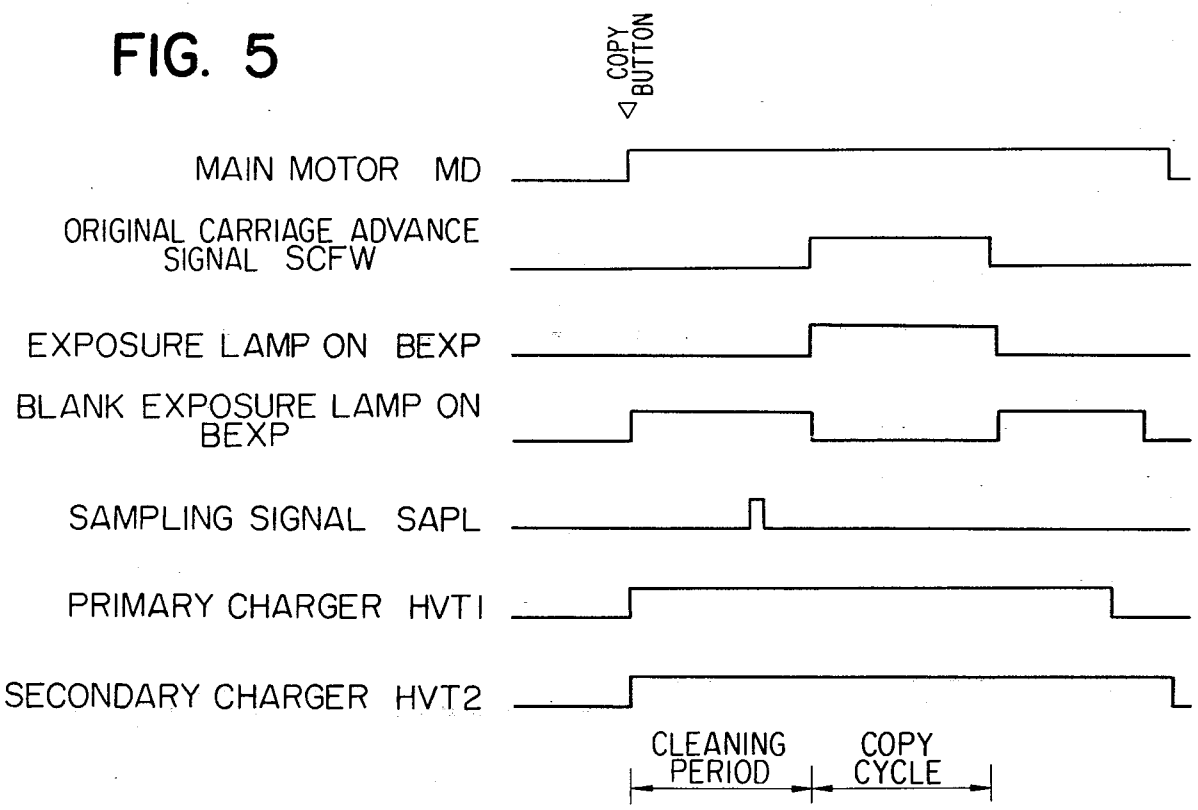
FIG. 5 is a timing chart of the copying apparatus of FIG. 1.
Figure 5:
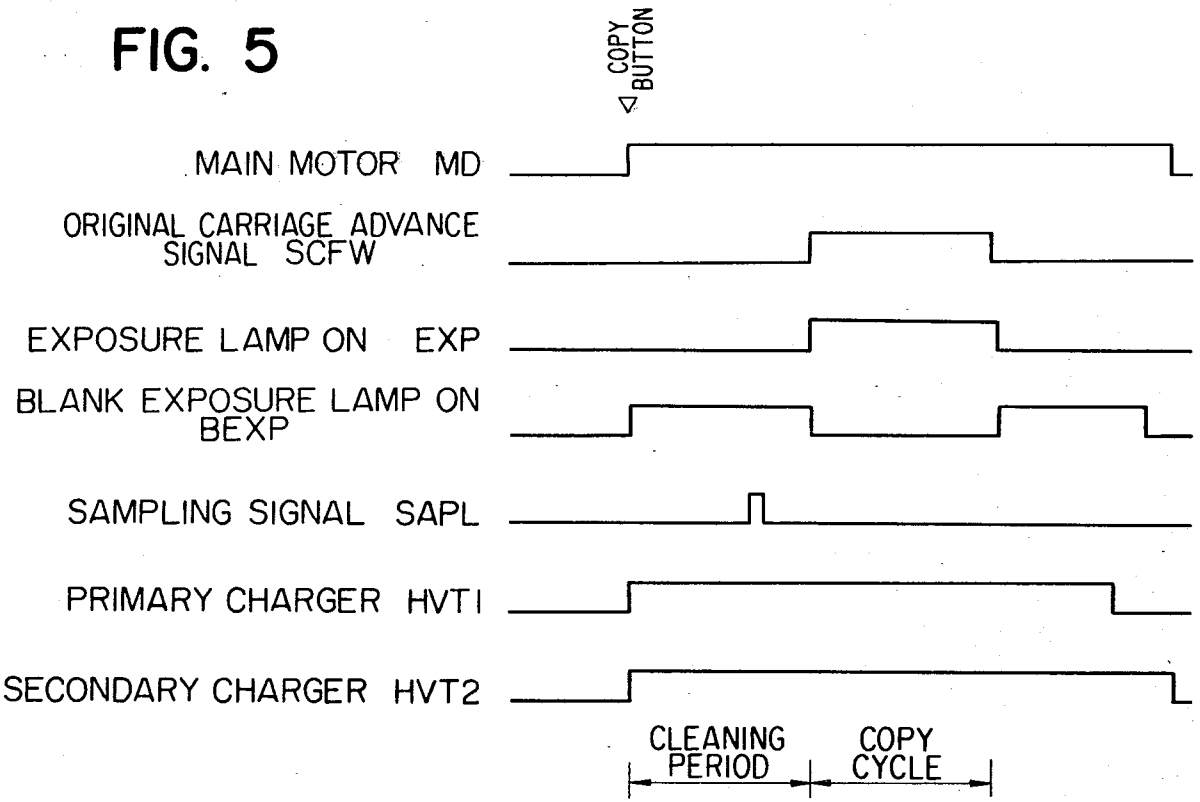

Change the legend at the top of the drawing which bears Fig. 5 to read --Sheet 3 of 5--.

Change the legend at the top of the drawing which bears Fig. 6 to read --Sheet 4 of 5--.

Change the legend at the top of the drawing which bears Fig. 10 to read --Sheet 5 of 5--.

Signed and Sealed this

*Twenty-third* Day of *July 1985*

[SEAL]

*Attest:*

DONALD J. QUIGG

*Attesting Officer* *Acting Commissioner of Patents and Trademarks*